US011703221B2

(12) United States Patent
Lundberg et al.

(10) Patent No.: US 11,703,221 B2
(45) Date of Patent: Jul. 18, 2023

(54) FLUE DAMPER HAVING A FLOAT COUPLED TO A DAMPER GATE

(71) Applicants: Field Controls, L.L.C., Kinston, NC (US); Rheem Manufacturing Company, Atlanta, GA (US)

(72) Inventors: Mark R. Lundberg, Greenville, NC (US); Cory A. Weiss, Warren, MI (US); Kyle R. Glover, Kinston, NC (US); Takashi Nozaki, Montgomery, AL (US)

(73) Assignee: FIELD CONTROLS, L.L.C., Kinston, NC (US)

( * ) Notice: Subject to any disclaimer, the term of this patent is extended or adjusted under 35 U.S.C. 154(b) by 319 days.

(21) Appl. No.: 17/023,005

(22) Filed: Sep. 16, 2020

(65) Prior Publication Data

US 2022/0082252 A1 Mar. 17, 2022

(51) Int. Cl.
*F23L 17/14* (2006.01)
*F23L 13/02* (2006.01)

(52) U.S. Cl.
CPC ..... *F23L 17/14* (2013.01); *F23L 13/02* (2013.01)

(58) Field of Classification Search
CPC . F23L 17/14; F23L 13/02; F23L 11/00; F23L 11/02; F23L 11/005
USPC ..... 454/367, 1–37
See application file for complete search history.

(56) References Cited

U.S. PATENT DOCUMENTS

| | | | | |
|---|---|---|---|---|
| 6,405,766 | B1 | 6/2002 | Benjey | |
| 6,854,428 | B1 | 2/2005 | Hotton et al. | |
| 7,814,868 | B2 | 10/2010 | Yin et al. | |
| 8,113,823 | B2 | 2/2012 | Guzorek | |
| 9,322,568 | B2 | 4/2016 | Aycock | |
| 9,581,355 | B2 | 2/2017 | Boros et al. | |
| 9,835,330 | B2 | 12/2017 | Guzorek et al. | |
| 9,958,184 | B2 | 5/2018 | Aycock | |
| 10,240,787 | B2 | 3/2019 | Hokanson | |
| 2014/0027660 | A1 | 1/2014 | Guzorek | |
| 2018/0283685 | A1* | 10/2018 | Leung | F16K 15/023 |

* cited by examiner

*Primary Examiner* — Vivek K Shirsat
(74) *Attorney, Agent, or Firm* — Shook, Hardy & Bacon, L.L.P.

(57) ABSTRACT

A flue damper may include a flue pipe with a first side leading to an outlet of the flue damper and a second side leading to an inlet of the flue damper. A damper gate may be included and have an open state and a closed state, where in the open state, the first side of the flue pipe is in fluid communication with the second side, and where in the closed state, the damper gate interrupts fluid communication between the first side and the second side. A float may be secured to an upper surface of the damper gate. The upper surface of the damper gate may face the first side of the flue pipe when the damper gate is in the closed state such that the damper gate at least partially opens when condensate collects within the first side of the flue pipe.

20 Claims, 4 Drawing Sheets

FLUE DAMPER HAVING A FLOAT COUPLED TO A DAMPER GATE

BACKGROUND

Buildings are often heated using a gas-fired heating device or other heating device providing thermal energy for heating a building, herein referred to as a "heating appliance." A typical heating appliance includes a gas burner for generating heat, which may be transferred through a heat exchanger to a living space of a building. Exhaust gasses (or flue gasses) from the heating appliance may the building via an exhaust vent, which may be a pipe leading from the heating appliance to the external atmosphere.

Today's high efficiency heating equipment typically operates under a positive vent pressure during operation (i.e., a pressure above atmospheric pressure). The high pressure generally comes from the use of high pressure fans used to push the combustion flue products through the equipment's heat exchanger. There is generally a need to seal the vents for this type of equipment when two or more heating units are vented to the outside of a building through a common duct. For example, if a first unit is operating, and second and third units are not operating, the flue gases from the first unit may unintentionally flow into the other two heating units. This potential flow of exhaust gases into the non-operating second and third units can cause equipment failures or leakage of flue gases into the occupied building space. Vent pressurization can also occur due to wind loads or other changes to the building's exterior environment.

In prior heating systems, flue dampers have been included. The flue damper may include a movable plate, or "damper gate," located in a pipe that opens and closes to selectively regulate airflow through that pipe. While dampers have been used with success, liquid water (e.g., condensate) may collect on top of the damper under certain conditions. If enough water collects, a motor connected to the damper may be unable to open the damper gate due to the weight and/or pressure of the collected condensate. The present embodiments address this issue.

DESCRIPTION OF THE DRAWINGS

The components in the figures are not necessarily to scale, emphasis instead being placed upon illustrating the principles of the invention. Moreover, in the figures, like referenced numerals designated corresponding parts throughout the different views.

DETAILED DESCRIPTION

Figure 1:
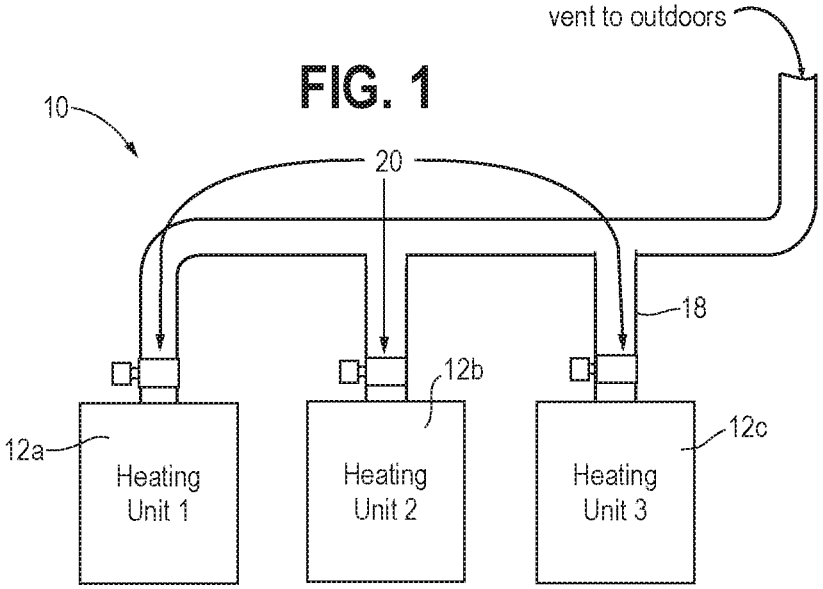
FIG. 1 is an illustration showing an arrangement of heating equipment that may operate under a positive vent pressure (i.e., above atmospheric pressure) during operation in accordance with certain aspects of the present disclosure.

The present embodiments are described with reference to the drawings in which like elements are referred to by like numerals. The relationship and functioning of the various elements of this invention are better understood from the following detailed description. However, the embodiments of the invention are not limited to the embodiments illustrated in the drawings. It should be understood that in certain instances, details have been omitted which are not necessary for an understanding of the present invention, such as conventional fabrication and assembly.

FIG. 1 is an illustration showing an arrangement of heating equipment 10 that operates under a positive (above atmospheric pressure) vent pressure during operation. The high pressure comes from the use of high pressure fans used to push the combustion flue products through the equipment's heat exchanger. Sealing the vents for this type of equipment is generally needed when two or more heating units are vented to the outside of the building through a common vent/duct, as depicted in FIG. 1. For example, if a first unit 12*a* is operating, and second and third units 12*b* and 12*c* are not operating, the flue gases from the first unit 12*a* could flow through the common exhaust network 18 and into the other two heating units 12*b* and 12*c*. This potential flow of exhaust gases into the non-operating second and third units 12*b* and 12*c* can cause equipment failures or leakage of flue gases into the occupied building space. Thus, the flue dampers 20 are provided and are designed to close when their respective heating units are not operating.

Figure 2:
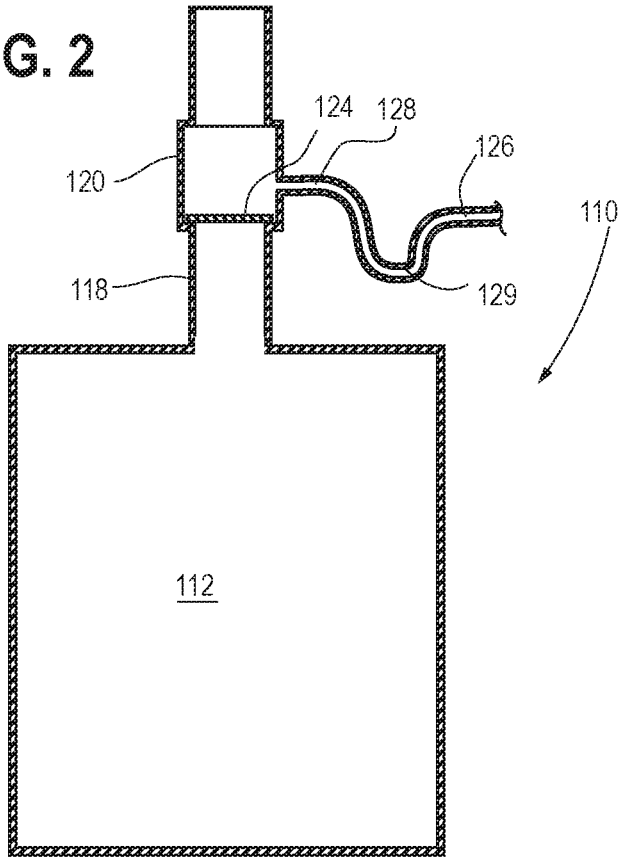
FIG. 2 is an illustration showing a heating system with a flue damper including a drainage pipe in accordance with certain aspects of the present disclosure.

FIG. 2, of which certain aspects may be prior art, is an illustration of an embodiment of a heating system 110 with a flue damper 120 in communication with a vent 118. As shown, the heating system 110 includes a heating appliance 122 (such as a water-heater or another suitable heater), and the flue damper 120 may selectively control flow of gasses (such as exhaust gasses) through the vent 118, which may lead to an external environment outside of a building. Under some conditions, such as when the temperature within the flue damper 120 and/or the vent 118 is lower than the point at which the internal gasses begin to become saturated with water vapor, condensate (which is typically water) may collect within the flue damper 120, particularly when a damper gate 124 of the flue damper 120 is closed (as shown in FIG. 2).

Without intervention, the condensate may build on top of the damper gate 124. This may be problematic since it can increase the force needed to open the damper gate 124 due to the weight of the condensate (e.g., water pressure) on top of the damper gate 124. In other words, without intervention, a motor or other device coupled to the damper gate 124 for mechanically opening and/or closing the damper gate 124 must be able to lift the damper gate 124 along with the condensate located above the damper gate 124 such that the condensate could drain through the vent 118 and into the heating appliance 112 (which typically includes its own means of dealing with condensates and other liquids). This is problematic since, without reducing the size of the motor coupled to the damper gate 124 (which also increases costs), the motor may be incapable of opening the damper gate 124 when collected condensate reaches a certain level. Failure of the damper gate 124 to open may interrupt the heating process (due to automatic shut-down of the heating system 110) and/or may create a safety hazard if exhaust gasses cannot escape through the vent 118.

To address this issue, the heating system 110 of FIG. 2 includes the drainage pipe 126. The drainage pipe 126 may include an inlet 128 located at the bottom of the flue damper 120, as shown, such that condensate flows out of the flue damper 120 when it reaches a certain level (e.g., high enough to create a buoyancy lift force to overcome gravity). The drainage pipe 126 may have include an optional drain trap 129 (e.g., a curved portion of the drainage pipe 126) to create a water seal within the pipe, particularly if the drainage pipe 126 leads to a sewer system or other system for disposing of wastewater. Optionally, the drainage pipe 126 may lead to an outlet located in a wastewater system (e.g., a sewer system) for disposing of the condensate, and/or the condensate may flow into the heating appliance 112.

Figure 3:
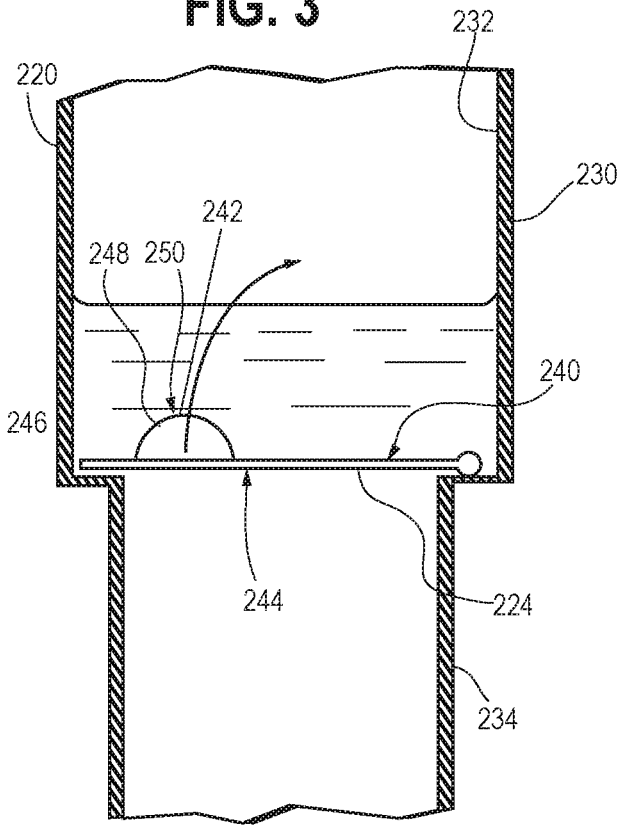
FIG. 3 is an illustration showing a flue damper with a damper plate having a float in accordance with certain aspects of the present disclosure.

FIG. 3 is an illustration showing another embodiment of a flue damper 220. As shown, the flue damper 220 includes a flue pipe 230 with a first side 232 leading to an outlet of the flue damper (and potentially to the external environment for venting exhaust gasses) and a second side 234 leading the heating appliance. A damper gate 224 may be included to control flow of gasses through the flue damper 220. For example, the damper gate 224 may include an open state and a closed state, where in the open state (not shown), the first side 232 of the flue pipe 230 is in fluid communication with the second side 234 of the flue pipe 230. In contrast, when the damper gate 224 is in the depicted closed state, the damper gate 224 seals or otherwise interrupts fluid communication between the first side 232 and the second side 234 of the flue pipe 230.

As described above, when the damper gate 224 is closed, condensate 238 may build up above an upper surface 240 of the damper gate 224 under certain conditions. Other sources of liquid may include rainwater, leaks within plumbing of the building, etc. To address the buildup of this liquid, a float 242 may be secured to the upper surface 240 of the damper gate 224. Without limitation, the float 242 may include a material such as a plastic, foam, rubber, etc. that creates buoyance. Additionally or alternatively, the float 242 may be shaped to hold a bubble of gas or another light substance (or vacuum) to create buoyancy. As the condensate 238 collects, the buoyancy of the float 242 may provide an upward-force on at least a portion of the damper gate 224. Once the condensate 238 reaches a certain level, the force provided by the buoyancy of the float 242 may overcome the weight of the damper gate 224 along with the water pressure, thus causing the damper gate 224 to at least partially open, and to move away from its closed state.

Figure 4:
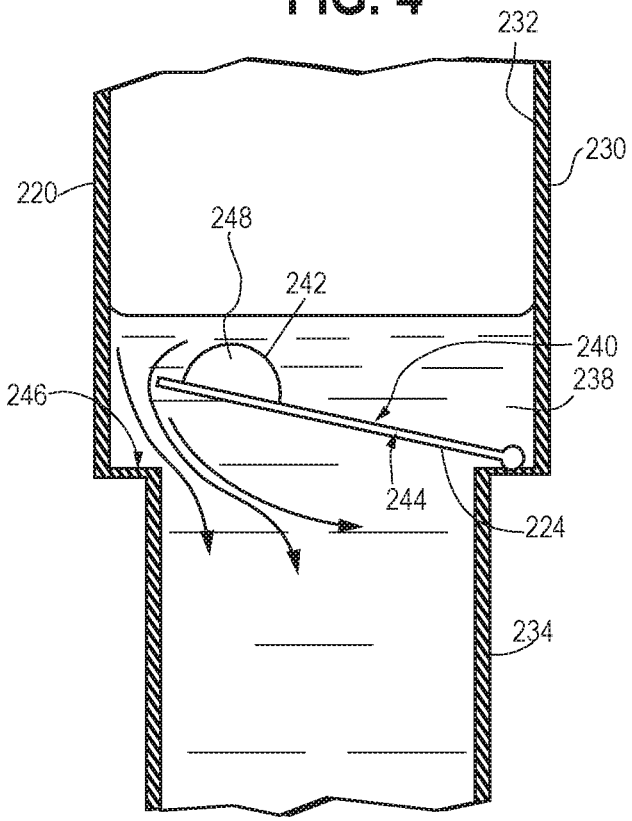
FIG. 4 is an illustration showing the flue damper of FIG. 3, where the damper plate has moved away from its closed state such that condensate can drain in accordance with certain aspects of the present disclosure.

FIG. 4 is an illustration showing the damper gate 224 as it opens in response to the buildup of the condensate 238. Once the damper gate 224 begins to open, a lower surface 244 of the damper gate 224 lifts away from a seal surface 246, thus allowing flow of fluids through the flue damper 220. More specifically, the first side 232 of the flue pipe 230 is in fluid communication with the second side 234 of the flue pipe 230 when the damper gate 224 at least partially opens, which allows the condensate to flow through the flue pipe 230 and into the heating appliance and/or into a drainage/wastewater system (due to gravity).

The float 242 may have any suitable structure and/or material composition to provide buoyancy, and the float 242 may be integral with the damper gate 224 or alternatively provided as a separate component that is secured to the damper gate 224. For example, in FIGS. 3-4, the float is formed integrally with the damper gate 224 and includes a "bubble" or chamber 248 filled with air, another gas, or a vacuum. In other embodiments, the chamber 248 may be filled with a foam or another low-density material associated with high-buoyancy. The top surface 250 (shown in FIG. 3) of the chamber 248 may be formed with a material that also forms the upper surface 240 of the damper gate 224. For example, one method of manufacture may include molding the damper gate 224 and injecting a low-density gas prior to setting of the molded material to form the chamber 248. Any other suitable method of manufacture may also be used.

Figure 5:
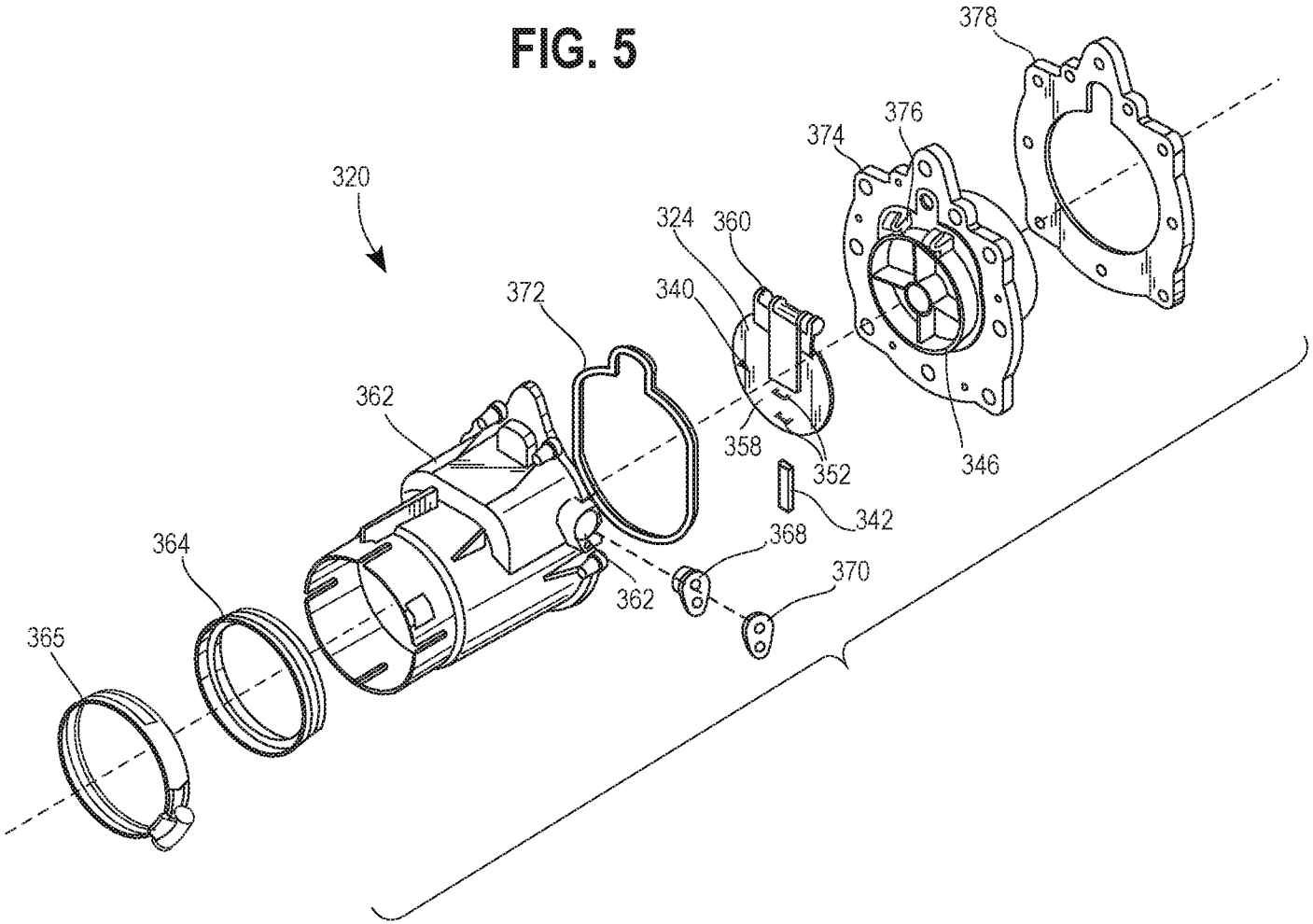
FIG. 5 is an illustration showing an exploded view of a flue damper with a float that is secured to a damper plate through an interface in accordance with certain aspects of the present disclosure.

FIG. 5 shows another embodiment of a flue damper 320. The flue damper 320 of FIG. 5 includes a float 342 that is not integral with a damper gate 324, but is instead secured to an upper surface 340 of the damper gate 324 (e.g., after the damper gate 324 is fully manufactured). For example, the damper gate 324 includes an interface, which in this case includes a plurality of brackets 352. The brackets 352 each include an opening for receiving at least a portion of the float 342 (e.g., in a friction-fit or press-fit manner). To enhance lift on one side of the damper plate, the float 342 may be located near an edge 358 that is substantially opposite a hinge 360 where the damper gate 324 pivots (e.g., enhancing torque provided by the float 342 due to increase distance from the pivot point coupled to the hinge 360). The float 342 may be an air-filled structure, a foam structure (or foam-filled structure), or any other suitable structure with a relatively-high buoyancy.

The remaining elements of the flue damper 320 may include an upper housing portion 362 which forms a portion of a vent-pipe (as described above), such as the outer walls of the vent pipe. An internal seal 364 and clamp 365 may be included to seal the upper housing portion 362 relative to another portion of the vent (not shown) leading to an external environment. An accessory port 366, along with an accessory port seal 368 and cover 370, may be included (e.g., for providing access for an accessory, such as a sensor). A formed seal 372 may provide sealing between the upper housing portion 362 and a lower housing portion 374. The damper gate 324 may be pivotally secured to the lower housing portion 374 at a pivot point 376 (which couples to the hinge 360). The lower housing portion 374 may include a seal surface 346 that abuts the damper gate 324 when the damper gate 324 is in the closed state, thus interrupting flow of fluids through the flue damper 320. Finally, a lower seal 378 may provide sealing between the lower housing portion 374 and another portion of the vent (not shown) leading to the heating appliance. These components are included as examples only, and additional components may be included, and/or certain components may be left out.

Figures 6, 7, 8:
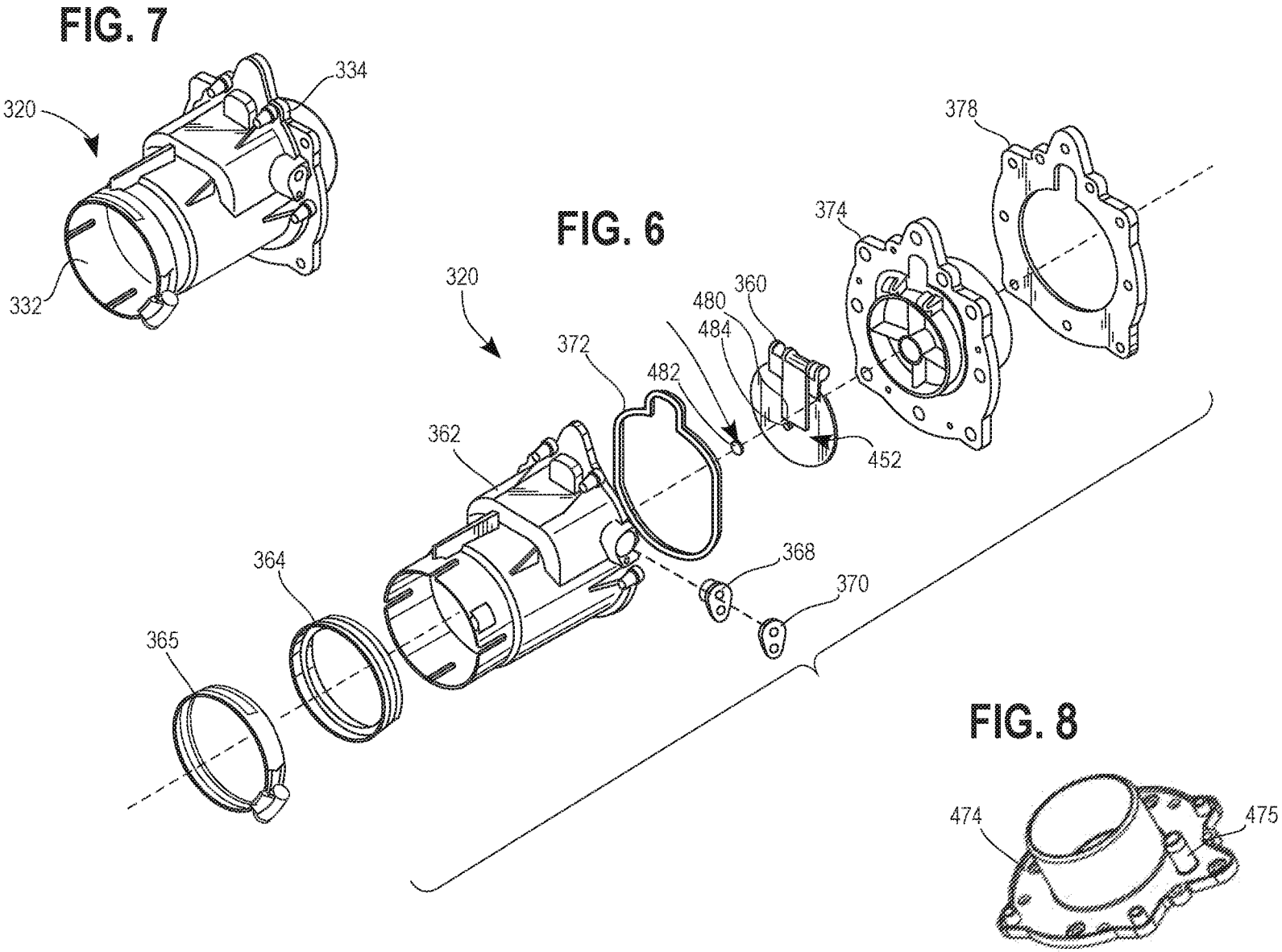
FIG. 6 is an illustration is an illustration showing an exploded view of another embodiment of a flue damper with a float that is secured to a damper plate through an interface in accordance with certain aspects of the present disclosure.
FIG. 7 is an illustration showing a perspective view of the flue dampers of FIG. 5 and FIG. 6 when assembled.
FIG. 8 is an illustration showing a perspective view of a housing portion for a flue damper having a drainage port in accordance with certain aspects of the present disclosure.

FIG. 6 is an illustration showing a flue damper 320 that is similar to that of FIG. 5 (and each reference number described above with reference to FIG. 5 also applies to elements of FIG. 6, unless stated otherwise). The primary difference between the embodiments of FIG. 5 and FIG. 6 is that the embodiment of FIG. 6 includes a different interface 452 on the damper gate 324 along with a float 442 having a different shape. As shown in FIG. 6, the interface may include a protrusion 480 that is received by an opening 482 of the float 442 (e.g., in a friction-fit or press-fit manner). Optionally, the protrusion 480 may include a knob 484 on its top end that has a cross-sectional diameter that is larger than a diameter of the opening 482 of the float 442, which may ensure retention of the float 442 on the protrusion 480. Any other suitable interface, and/or any other suitable float structure, may be included.

FIG. 7 is an illustration showing the flue damper 320 as it may appear when assembled. The first side 332 of the flue damper 320 may lead to the external environment, the second side 334 may lead to a heating appliance, and the above-described damper gate may provide control of flow therebetween.

FIG. 8 is an illustration showing a lower housing portion 474, which includes a drain port 475. The lower housing portion 474 may be included as an alternative to the lower housing portion 374 discussed above and shown in FIG. 6, for example. Further, it is contemplated that aspects of the lower housing portion 474 (such as the drain port 475) may be combined with other suitable features described herein, such as a movable damper plate coupled to a float.

When the lower housing portion 474 of FIG. 8 is used, the drainage port 475 may provide direct drainage for condensate that collects in an area outside the perimeter of a damper plate. For example, while the above-described damper embodiments (and iterations thereof) may address condensate directly above the damper plate (e.g., via a float), other condensate that occurs within the system may remain unaddressed. This condensate may include moisture that collects in areas outside the outer perimeter edge of the damper and particularly areas where such condensate is blocked from flowing onto the damper plate. The drain port 475 addresses this condensate by providing an additional drainage path directly to outside of flue pipe. If included, the drain port 475 (and/or similar drain ports) may be located in any suitable area on the same plane of the associated damper plate.

Having described various aspects of the subject matter, additional disclosure is provided below, which includes certain aspects consistent with the originally-filed claims located at the end of this specification.

In one aspect, a flue damper may include one or more of the following: a flue pipe with a first side leading to an outlet of the flue damper and a second side leading to an inlet of the flue damper; a damper gate with an open state and a closed state, where in the open state, the first side of the flue pipe is in fluid communication with the second side, and where in the closed state, the damper gate interrupts fluid communication between the first side and the second side; and a float secured to an upper surface of the damper gate. The upper surface of the damper gate may face the first side of the flue pipe when the damper gate is in the closed state such that the damper gate at least partially opens when condensate collects within the first side of the flue pipe due to buoyancy of the float.

In some embodiments, the damper gate moves out of the closed state when about 1 inches, or less, of condensate is collected above the upper surface of the damper gate.

In some embodiments, the float includes an air pocket located within a material forming the upper surface of the damper gate.

In some embodiments, the float includes a material with a buoyancy for creating a force that is at least equal to the weight of the damper gate.

In some embodiments, the upper surface of the damper gate includes an interface with at least one opening for receiving the float.

In some embodiments, the float includes at least one opening for receiving a protrusion extending from the upper surface of the damper gate.

In some embodiments, the float is located on an edge of the damper plate opposite a hinge coupled to the damper plate.

In a second aspect, the flue damper may include one or more of the following: a damper gate that is movable between an open state and a closed state, where in the closed state, a lower surface of the damper gate abuts a sealing surface; and a float secured to an upper surface of the damper gate such that the damper gate moves away from the closed state when condensate collects on top of the damper gate due to buoyancy of the float.

In some embodiments, the damper gate moves away from the closed state when about 1 inches, or less, of condensate is collected above the upper surface of the damper gate.

In some embodiments, the float includes an air pocket located within a material forming the upper surface of the damper gate.

In some embodiments, the float includes a material with a buoyancy for creating a force that is at least equal to the weight of the damper gate.

In some embodiments, the upper surface of the damper gate includes an interface with at least one opening for receiving the float.

In some embodiments, the float includes at least one opening for receiving a protrusion extending from the upper surface of the damper gate.

A third aspect relates to a method. The method may include assembling a flue damper including a flue pipe with a first side leading to an outlet of the flue damper and a second side leading to an inlet of the flue damper, where the flue damper includes a damper gate with an open state and a closed state, where in the open state, the first side of the flue pipe is in fluid communication with the second side, and where in the closed state, the damper gate interrupts fluid communication between the first side and the second side, where the flue damper includes a float secured to an upper surface of the damper gate, and where the upper surface of the damper gate faces the first side of the flue pipe when the damper gate is in the closed state such that the damper gate at least partially opens when condensate collects within the first side of the flue pipe due to buoyancy of the float.

In some embodiments, the damper gate moves out of the closed state when about 1 inches, or less, of condensate is collected above the upper surface of the damper gate.

In some embodiments, the float includes an air pocket located within a material forming the upper surface of the damper gate.

In some embodiments, the float includes a material with a buoyancy for creating a force that is at least equal to the weight of the damper gate.

In some embodiments, the upper surface of the damper gate includes an interface with at least one opening for receiving the float.

In some embodiments, the float includes at least one opening for receiving a protrusion extending from the upper surface of the damper gate.

In some embodiments, a seal surface may abut a lower surface of the damper gate when the damper gate is in the closed state, and where the damper gate moves away from the seal surface when it at least partially opens upon receipt of the condensate within the first side of the flue pipe.

While various embodiments of the invention have been described, the invention is not to be restricted except in light of the attached claims and their equivalents. Moreover, the advantages described herein are not necessarily the only advantages of the invention and it is not necessarily expected that every embodiment of the invention will achieve all of the advantages described.

We claim:

1. A flue damper, comprising:

a flue pipe with a first side leading to an outlet of the flue damper and a second side leading to an inlet of the flue damper;

a damper gate coupled, via a hinge, to a portion of the flue pipe, the damper gate comprising an open state and a closed state, wherein in the open state, the first side of the flue pipe is in fluid communication with the second side, and wherein in the closed state, the damper gate interrupts fluid communication between the first side and the second side; and a float secured to an upper surface of the damper gate, wherein the upper surface of the damper gate faces the first side of the flue pipe when the damper gate is in the closed state such that the damper gate at least partially opens when condensate collects within the first side of the flue pipe due to buoyancy of the float.

2. The flue damper of claim 1, wherein the damper gate moves out of the closed state when about 1 inches, or less, of condensate is collected above the upper surface of the damper gate.

3. The flue damper of claim 1, wherein the float includes an air pocket located within a material forming the upper surface of the damper gate.

4. The flue damper of claim 1, wherein the float includes a material with a buoyancy for creating a force that is at least equal to the weight of the damper gate.

5. The flue damper of claim 1, wherein the upper surface of the damper gate includes an interface with at least one opening for receiving the float.

6. The flue damper of claim 1, wherein the float includes at least one opening for receiving a protrusion extending from the upper surface of the damper gate.

7. The flue damper of claim 1, wherein the float is located on an edge of the damper plate opposite the hinge.

8. The flue damper of claim 1, wherein a housing portion of the flue damper includes a drainage port for draining condensate occurring inside the flue path and allows for direct draining of condensate to outside of the flue path of the damper plate.

9. A flue damper, comprising:

a damper gate that is hingedly movable between an open state and a closed state, wherein in the closed state, a lower surface of the damper gate abuts a sealing surface; and a float secured to an upper surface of the damper gate such that the damper gate hinges away from the closed state when condensate collects on top of the damper gate due to buoyancy of the float.

10. The flue damper of claim 9, wherein the damper gate moves away from the closed state when about 1 inches, or less, of condensate is collected above the upper surface of the damper gate.

11. The flue damper of claim 9, wherein the float includes an air pocket located within a material forming the upper surface of the damper gate.

12. The flue damper of claim 9, wherein the float includes a material with a buoyancy for creating a force that is at least equal to the weight of the damper gate.

13. The flue damper of claim 9, wherein the upper surface of the damper gate includes an interface with at least one opening for receiving the float.

14. The flue damper of claim 9, wherein the float includes at least one opening for receiving a protrusion extending from the upper surface of the damper gate.

15. A method, comprising:

assembling a flue damper including a flue pipe with a first side leading to an outlet of the flue damper and a second side leading to an inlet of the flue damper, wherein the flue damper includes a damper gate hingedly attached to the flue damper and hingedly moveable between an open state and a closed state, wherein in the open state, the first side of the flue pipe is in fluid communication with the second side, and wherein in the closed state, the damper gate interrupts fluid communication between the first side and the second side, wherein the flue damper includes a float secured to an upper surface of the damper gate, and wherein the upper surface of the damper gate faces the first side of the flue pipe when the damper gate is in the closed state such that the damper gate at least partially opens when condensate collects within the first side of the flue pipe due to buoyancy of the float.

16. The method of claim 15, wherein the damper gate moves out of the closed state when about 1 inches, or less, of condensate is collected above the upper surface of the damper gate.

17. The method of claim 15, wherein the float includes an air pocket located within a material forming the upper surface of the damper gate.

18. The method of claim 15, wherein the float includes a material with a buoyancy for creating a force that is at least equal to the weight of the damper gate.

19. The method of claim 15, wherein the upper surface of the damper gate includes an interface with at least one opening for receiving the float.

20. The method of claim 14, wherein a seal surface abuts a lower surface of the damper gate when the damper gate is in the closed state, and wherein the damper gate moves away from the seal surface when it at least partially opens upon receipt of the condensate within the first side of the flue pipe.

* * * * *